United States Patent [19]

Coleman

[11] 4,156,219

[45] May 22, 1979

[54] ELECTRIC CIRCUIT BREAKER

[75] Inventor: Edward Coleman, Inkpen, England

[73] Assignee: Ottermill Limited, Devon, England

[21] Appl. No.: 753,979

[22] Filed: Dec. 23, 1976

[30] Foreign Application Priority Data

Jan. 12, 1976 [GB] United Kingdom ..... 998/76

[51] Int. Cl.[2] ..... H01H 00/00; H01H 9/00; H01H 9/54

[52] U.S. Cl. ..... 335/175; 335/23; 335/35

[58] Field of Search ..... 335/23, 35, 41, 175, 335/39

[56] References Cited

U.S. PATENT DOCUMENTS

| | | | |
|---|---|---|---|
| 3,040,144 | 6/1962 | Norden | 335/41 |
| 3,278,708 | 10/1966 | Casey et al. | 335/35 |

*Primary Examiner*—Harold Broome

*Attorney, Agent, or Firm*—Robert E. Converse, Jr.

[57] ABSTRACT

A circuit breaker having separable contacts, thermal and magnetic trip means, a flexible conductive braid connecting the contacts and the trip means, and a latch mechanism for producing a series of vibrating impacts upon overcurrent conditions also includes a latch member of electrically insulating material to prevent undesirable parallel current paths and to increase the interruption current rating of the breaker.

3 Claims, 2 Drawing Figures

ELECTRIC CIRCUIT BREAKER

BACKGROUND OF THE INVENTION

1. Field of the Invention

The invention relates to electric circuit breakers, and more particularly to molded case circuit breakers having a flexible braid in the current path.

2. Description of the Prior Art

Electric circuit breakers are known, having electromagnetic tripping means which cause instantaneous tripping of the breaker when a current flows through the breaker which is in excess of a predetermined threshold current. Such a threshold current may, for example, be between three and five times the rated normal operating current for the breaker. Electric circuit breakers are also known, having tripping means in the form of bimetallic members which are resistively heated by the current flowing through the breaker and which trip the breaker when a current flows through the breaker which is in excess of a predetermined threshold current. It is also known to use a combination of electromagnetic tripping means and bimetallic tripping means.

Tripping arrangements for circuit breakers usually use a movable latch member for holding an actuating member of a switching arrangement of the breaker until the breaker is tripped by moving the latch member so as to unlatch the actuating member. The actuating member is then free to move under the action of spring means contained in the switching arrangement, so that the previously closed contacts of the switching arrangement are rapidly opened.

Irrespective of whether the tripping arrangement uses electromagnetic tripping means, or bimetallic tripping means, or both, the electric current flowing through the breaker passes through the tripping arrangement. Usually, the current is conducted to the tripping arrangement from a movable contact of the breaker, by way of a conductive flexible metallic braid one end of which is connected to a movable-contact-carrying element, and the other end of which is connected to the electromagnet or bimetallic member of the tripping arrangement.

In the confined interior space of small circuit breakers, it is easy for the conductive braid to touch the latch member, which itself may touch other current-carrying parts of the tripping arrangement, thus establishing an undesired parallel current flow path. For example, when electromagnetic tripping is used, the said other end of the braid is connected to one terminal of a tripping electromagnet. If, undesirably, the braid were also to touch a current carrying part of the tripping arrangement at a place subsequent to the other terminal of the electromagnet, either directly, or by way of touching the latch member, a parallel current flow path would be established which would shunt the electromagnet and thus impair its action.

In small circuit breakers, the above-mentioned actuating member is usually part of a cradle member which is linked to the movable-contact-carrying element of the breaker by way of an overcenter spring. There thus exists the danger that a parallel current flow path can be established from the movable-contact-carrying element through the overcenter spring, the cradle member and the latch member, to the bimetallic or electromagnetic tripping arrangement, rather than solely through the metallic braid.

SUMMARY OF THE INVENTION

The invention consists in an electric circuit breaker comprising a switching arrangement having a stationary contact and a movable contact which are brought into engagement to complete an electric circuit when the breaker is in a closed condition and which are separated to interrupt the circuit when the breaker is tripped, the switching arrangement having an actuating member which is held by a movably mounted latch member when the breaker is in the closed condition and which is released by the latch member for actuating the switching arrangement to an open condition when the breaker is tripped, tripping means being provided which move the latch member and thereby release the actuating member and trip the breaker, when a current in excess of a given threshold current flows through a current carrying element of the tripping means, the movable contact being connected to the said current-carrying element by way of a flexible conductor, the latch member being made of electrically insulating material.

Preferably, the latch member is made of plastics material having high wear resistance and low coefficient of friction. It will be appreciated that the insulating latch member acts as a barrier, normally preventing the flexible conductor and the actuating member from contacting any of the metal parts of the tripping arrangement, thus preventing the establishing of the above-mentioned undesirable parallel current flow.

Preferably, the said actuating member is made of die-cast metal, and the latch member is made of glass filled nylon.

BRIEF DESCRIPTION OF THE DRAWINGS

In order to make the invention clearly understood, reference will now be made to the accompanying drawing which is given by way of example and in which.

DESCRIPTION OF THE PREFERRED EMBODIMENT

Figure 1:
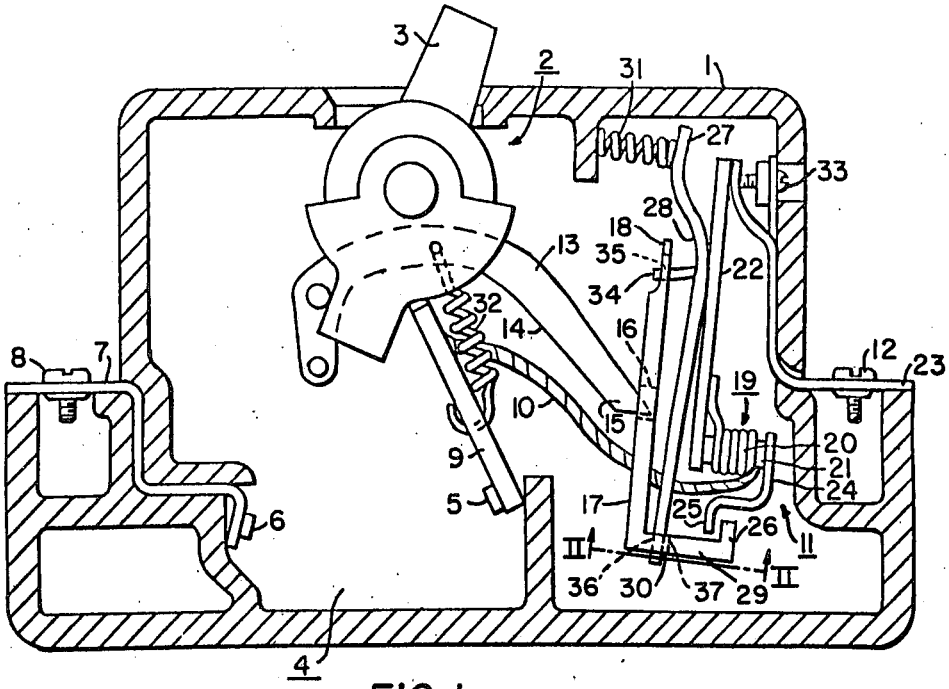
FIG. 1 is a diagrammatic sectional view through an electric circuit breaker embodying the features of the invention.
Figure 2:
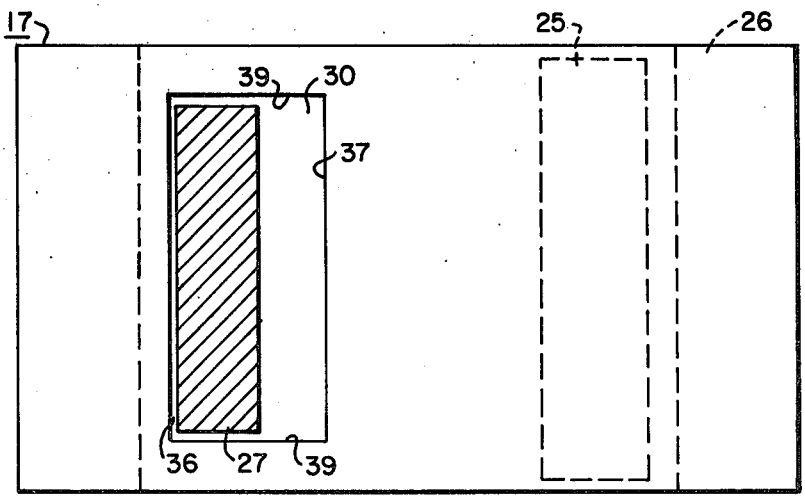
FIG. 2 is a detailed sectional view of the armature and latch member taken along the line II—II of FIG. 1.

The circuit breaker comprises a housing 1 of insulating material in which an overcenter spring mechanism 2 is provided which can be set by an operating lever 3 for operating a switching arrangement 4 so that a movable contact 5 can be brought into engagement with a fixed contact 6, or separated therefrom. The fixed contact 6 is connected by a metal strip 7 to a terminal 8 of the breaker and the movable contact 5 is connected by way of a contact-carrying element 9 and a conductive metallic braid 10 and by way of a tripping arrangement 11, to a second terminal 12 of the circuit breaker.

The overcenter spring mechanism 2, and the switching arrangement 4, as well as the arrangement of the contacts 5 and 6 are conventional and will not be described in detail. Moreover, in view of the conventional nature of these portions of the circuit breaker, they have not been illustrated in detail, so as not to complicate the drawing.

The overcenter spring mechanism 2 comprises a cradle 13 and a tension spring 32 which extends between the movable contact-carrying element 9 and the cradle 13. The cradle 13 has an arm 14 which constitutes an actuating member by which the switching arrangement is actuated on tripping of the breaker. The actuating member 14 has a tapered end 15 which, when the breaker is in its closed condition, engages in an opening 16 in a latch member 17 which is pivoted to the housing 1 by means of lugs 18 on its end. The latch member 17 is made of glass-filled nylon which is electrically insulating, and the actuating member 14 is made of die-cast metal. This combination of materials provides long life and resistance to wear and the low coefficient of friction between these two materials facilitates tripping and resetting. By making the latch member 17 of electrically insulating material, it acts as an insulating barrier, preventing undesirable contact between the metallic braid 10 and parts of the tripping arrangement 11. Also, it ensures that the cradle arm 14, which is connected to the movable-contact-carrying element 9 by way of the spring 32, does not form part of a current-carrying path to any other part of the tripping arrangement.

The tripping arrangement 11 comprises an electromagnet 19 having a winding 20 and a core 21. The braid 10 is connected to one end of the winding 20 and the other end of the winding 20 is connected to a bimetallic member 22 which is fixed to a metal strip 23 which carries the second terminal 12 of the circuit breaker. The core 21 of the electromagnet is carried by an end of the bimetallic member 22 and the core also carries a bracket 24 which is cranked so as to have a portion 25 which can engage an upturned end portion 26 of the latch member 17 when the bimetallic member 22 has deflected by a certain extent on the passage therethrough of a sufficiently high current. A screw 33 is provided for exerting an adjusting force on the upper end of the bimetallic member 22, whereby to control the position of the cranked portion 25 of the bracket 24 in relation to the portion 26 of the latch member 17.

It will be seen that, when the bimetallic member 22 deflects, the cranked portion 25 of the bracket 24 will engage the upturned end portion 26 of the latch member 17, thus moving the latch member 17 about the pivot lugs 18 so as to release the actuating member 14 of the overcenter spring mechanism. This tripping action caused by deflection of the bimetallic member 22 is supplementary to a tripping action caused by the electromagnet 19, and the electromagnetic tripping will now be described.

The electromagnet 19 has an armature 27 of steel or iron, which is pivotally mounted against the bimetal member 22 at a fulcrum region 28. At one end, the armature 27 engages in a slot 30 in the lower portion 29 of the latch member 17, and at its other end, the armature 27 is acted on by a compression spring 31 which biases the armature 27 into a position such that at its said one end the armature 27 engages a long wall 36 of the slot 30, leaving a gap between the said one end of the armature 27 and the other long wall 37 of the slot 30. The slot 30 also has two short walls 39 connecting the long walls 36 and 37. The armature 27 has a guide lug 34 which extends into a slot 35 of the latch member 17, so as to assist in location of the armature 27.

When an alternating electric current flows through the circuit breaker and thus also through the electromagnet 19, an alternating magnetic field is produced which influences the armature 27. The dimensions of the electromagnet 19 should be such that when the normal rated current of the circuit breaker flows, the alternating magnetic field is not sufficient to cause any appreciable movement of the armature 27. However, when a current flows which is of a magnitude such that tripping of the circuit breaker is desired, the alternating magnetic field is of sufficient strength to influence the armature 27 and cause a vibration thereof. Consequently, the said one end of the armature 27 will exert a series of vibratory impacts on the latch member 17, these impacts being applied to the latch member by striking of the armature 27 against the wall 37 of the slot 30. Actuation of the latch member 17 by means of these impacts is more reliable than direct actuation of a latch member which itself constitutes an armature of an electromagnet, as the repeated impacts overcome the friction between the latch member and the actuating member very effectively. If the frequency of the electric current flowing through the circuit breaker is 50 cycles per second, then in a time period of 0.2 seconds, the armature will exert 20 impacts on the latch member. Consequently, reliable tripping of the breaker within a time period of 0.2 seconds can easily be obtained.

It will be appreciated that the latch member 17, being of plastics material, will act as an insulating barrier, preventing the metallic braid 10 from undesirably contacting the armature 27 or the bimetallic member 22, either directly or by way of a metallic latch member. Such contacting would establish a parallel current flow path shunting the electromagnet 19, and sufficient current may flow in such a parallel current flow path, during a short circuit condition in a circuit controlled by the breaker, to cause damage to or destruction of the tripping arrangement. The present invention practically eliminates the possibility of such an occurrence.

What is claimed is:

1. A circuit breaker adapted for alternating current operation, comprising:

separable contacts;

operating means releasable to effect automatic separation of said contacts;

electromagnetic trip means comprising an electromagnet coupled to said contacts and a movable magnetic member;

latch means engaging said operating means and comprising a latch member of electrically insulating material having a slot with two long walls and two short walls, said magnetic member extending into said slot, the distance between the long walls of said slot being sufficiently greater than the thickness of said magnetic member to provide said magnetic member with a degree of freedom of movement between said long walls; and bias means separate from said latch means for biasing said magnetic member in a direction away from said electromagnet and against one of said long walls;

an overcurrent condition through said contacts above a predetermined value energizing said electromagnet to vibrate said magnetic member in a direction parallel to a line connecting said long walls and generate a series of vibrating impacts between said magnetic member and said slot walls, said impacts effecting sufficient movement of said latch means to release said operating means to effect automatic separation of said contacts.

2. A circuit breaker as claimed in claim 1, wherein said latch means and said magnetic member are pivotally supported within a housing.

3. A circuit breaker as claimed in claim 2, further comprising a bimetal element supporting said electromagnet, and means coupling said bimetal element to said contacts, an overcurrent condition through said contacts below said predetermined value causing resistance heating of said bimetal element and deflection of said bimetal element against said latch member to effect release of said operating mechanism and automatic separation of said contacts.

* * * * *